US007037606B2

(12) United States Patent
Heim

(10) Patent No.: US 7,037,606 B2
(45) Date of Patent: May 2, 2006

(54) SECURITY ELEMENT

(75) Inventor: Manfred Heim, Munich (DE)

(73) Assignee: Giesecke & Devrient GmbH, (DE)

( * ) Notice: Subject to any disclaimer, the term of this patent is extended or adjusted under 35 U.S.C. 154(b) by 0 days.

(21) Appl. No.: 10/481,328

(22) PCT Filed: Jun. 24, 2002

(86) PCT No.: PCT/EP02/06966

§ 371 (c)(1),
(2), (4) Date: May 21, 2004

(87) PCT Pub. No.: WO03/002355

PCT Pub. Date: Jan. 9, 2003

(65) Prior Publication Data

US 2004/0207194 A1 Oct. 21, 2004

(30) Foreign Application Priority Data

Jun. 28, 2001 (DE) ..... 101 31 153

(51) Int. Cl.
*B41M 3/14* (2006.01)

(52) U.S. Cl. ..... 428/841.1; 283/82; 283/83; 283/85; 283/91; 283/72

(58) Field of Classification Search ..... 428/693, 428/841.1; 283/82, 83, 85, 91, 72
See application file for complete search history.

(56) References Cited

U.S. PATENT DOCUMENTS

| | | | | |
|---|---|---|---|---|
| 5,112,672 | A * | 5/1992 | Kaule et al. | 428/209 |
| 5,354,099 | A | 10/1994 | Kaule et al. | |
| 5,516,153 | A * | 5/1996 | Kaule | 283/85 |
| 6,146,773 | A * | 11/2000 | Kaule | 428/611 |
| 6,255,948 | B1 * | 7/2001 | Wolpert et al. | 340/572.8 |
| 6,318,758 | B1 * | 11/2001 | Stenzel et al. | 283/91 |
| 6,474,695 | B1 * | 11/2002 | Schneider et al. | 283/72 |
| 6,491,324 | B1 * | 12/2002 | Schmitz et al. | 283/82 |

FOREIGN PATENT DOCUMENTS

| | | |
|---|---|---|
| EP | 0 374 763 A | 6/1990 |
| EP | 0 914 970 A | 5/1999 |

* cited by examiner

*Primary Examiner*—Stevan A. Resan
(74) *Attorney, Agent, or Firm*—Rothwell, Figg, Ernest & Manbeck, PC

(57) ABSTRACT

A security element is equipped with first code of magnetic material and/or second code of electroconductive material and has in addition third, optically read-able code, for example as negative writing and/or as a bar code, which is present in the magnetic and/or electroconductive code or is produced preferably together with third, neutral material, the neutral material not being either electroconductive or magnetic. According to the invention it is provided that all three aforementioned materials are indistinguishable to the viewer optically, that is, with the naked eye, and therefore appear as a uniform coating made of a single material.

23 Claims, 2 Drawing Sheets

SECURITY ELEMENT

CROSS-REFERENCE TO RELATED APPLICATION

This application is a §371 of PCT International Application Serial No. PCT/EP02/06966, filed Jun. 24, 2002.

BACKGROUND OF THE INVENTION

Field of the Invention

The invention is in the field of security elements, particularly for bank notes.

Security threads are used as a security feature in a great variety of products, in particular security papers. One of the best known applications, which must meet extremely high security requirements, is the embedding of the security thread in bank note paper, the optical code in most cases forming positive or negative writing to be checked with the naked eye in transmitted light. The optical code can instead or additionally be a code to be checked by optical devices, in particular a bar code (WO 99/28852).

To impede imitation of the security thread, the thread is usually equipped with further security features in addition to the optical code, in particular an electroconductive coating and/or a coating with magnetic properties, said coatings being disposed one above the other. Such security features are tested by machine and therefore also referred to as "machine features." The optical code is usually formed by the machine features themselves by the associated coatings forming either positive writing or, through corresponding gaps in the coatings, negative writing. A customary way of producing the optical code is to partially demetalize a metalized thread, whereby the layer with magnetic properties thereabove is either removed at the same time (EP 0 748 896 A1), or disposed so as not to interfere with the demetalizing zones or applied so thin that the demetalized areas of the security thread are visually recognizable in transmitted light despite the magnetic layer present (EP 0 498 186 A1).

Instead of producing the electroconductive layer by vacuum metalization of the security thread, the electroconductive coating can also be applied as metal-pigmented printing ink, e.g. silver bronze (EP 0 516 790 B1, FIG. 8). Alternatively, the magnetic layer can additionally be made electroconductive by admixture of carbon black particles, so that all three security features—magnetic, electroconductive, negative writing—are produced simultaneously by printing a single layer.

In addition, it is known to apply the layer with magnetic properties in such a way that it forms a special code (EP 0 914 970 A2). Said magnetic code can consist of magnetic material or material that is detectable by magnetoresistors (EP 0 610 917 A1), the code being detectable not only due to the local distribution of material but also due to different magnetoresistive properties (EP 0 610 917 A1) or different magnetic layer thicknesses (EP 0 914 970 A2) or different magnetic properties such as remanence properties or coercivity (WO 99/28852).

From WO 99/28852 it is in addition known not only to apply the magnetic coating in the form of a special code but also to produce a special conductivity code by applying the electroconductive metal layer in certain portions.

If the optical code does not need to be visible in transmitted light, the magnetic coating can have, instead of gaps in the form of negative writing for example, a corresponding inscription printed on the magnetic layer with conventional ink (EP 0 610 917 A1, EP 0 748 896 A1).

A general concern with security threads is that potential forgers should not become aware of the presence of the machine features. This cannot be readily avoided, however, since a magnetic coating usually has a totally different appearance from an electroconductive metal coating with metallic luster.

WO 99/28852 therefore proposes disposing the magnetic layer and the electroconductive metal layer in exact register one above the other so that they completely conceal each other. This measure is only successful when the security thread is viewed only from one side or at least has an opaque base material. With security threads in bank notes whose optical code is tested in transmitted light, however, the security thread is usually transparent so that a different appearance would result depending on the viewing side. For this case of a security thread visible on both sides, EP 0 516 790 B1 and EP 0 748 896 A1 propose covering the magnetic coating with the electroconductive material completely on both sides so that a uniform appearance results in the paper in reflected and transmitted light.

A different manner of concealment is adopted by EP 0 914 970 A2, which proposes "masking" a magnetic bar code by providing masking bars of the same magnetic material in the areas between the magnetic bars, the masking bars differing from the bars forming the magnetic code only in the thickness of the material, and thus in the intensity of the magnetic feature. A potential forger is thus optically deceived since he will at first assume that the masking bars are part of the magnetic code. However, the production quality of the security thread and the measuring device quality for testing the security thread must meet very high requirements for the masking bars to be reliably recognized as such and not attributed to the magnetic code.

SUMMARY OF THE INVENTION

This invention relates to a security element, in particular for bank notes, having a carrier material and a magnetic code and/or a code independent thereof based on electroconductivity, hereinafter referred to as a conductivity code, and in addition an optical code. The invention further relates to a security document, in particular a bank note, having such a security element. The security element is in particular a security thread.

The problem of the present invention is to provide a security element, in particular for bank notes, that does not readily show all its security features and can be produced with little effort and reliably tested.

The inventive concealment of the security features of the security element is based on, among other things, applying different security features to a carrier material and forming said different security features of materials that are not distinguishable from each other optically, that is, with the naked eye. The carrier material can be an opaque or transparent material, preferably plastic, especially preferably transparent plastic.

Specifically, the inventive concealment is based on providing in addition to the technically testable security features ("machine features"), that is, in addition to the coating with the electroconductive material and/or the coating with the magnetic material, a further coating that does not have the characteristic physical properties of the machine features, i.e. is not electroconductive or does not have the special magnetic properties.

Said further coating of "neutral" material covers at least also areas of the security element that are not covered by the machine features. Since the viewer cannot distinguish between the individual materials he is faced with a visually recognizable pattern, for example a bar code or combination of characters (hereinafter "optical code"), that is formed by joint viewing of the areas covered by machine features and the areas covered by neutral material. The viewer cannot see whether or where in the optical code machine features might be located.

The machine feature areas and the areas of the security element covered with neutral material can be present separately from each other in the simplest case. However, more effective concealment results if the areas are adjacent or preferably overlap each other partly or optionally completely. An especially preferred embodiment provides that the security element is a security thread and that each longitudinal portion of the thread is provided with at least one of the coding materials so that the thread is coated over its total length with material looking the same. Said continuous coating preferably has gaps in the form of a negative writing as the optical code. In this case the viewer will at first think he is faced with a conventional, allover coated security thread having the typical gaps in the form of negative writing. Production of the inventive security element is especially simple if the different coating materials are based on printing inks that look the same and are admixed with particles having the machine-testable features. The uncoated areas of the security element associated with the optical code then do not need to be produced by an elaborate demetalizing method, but can simply remain unprinted. The invention is therefore especially suitable for a transparent security thread that is visible in transmitted light when embedded in the paper. For the purposes of increasing the contrast in transmitted light, the machine-testable coating materials and the neutral material are opaque, preferably dark, and preferably based on the same printing ink.

Additionally, further security features can be integrated into the security element, in particular a thermochromic and/or luminescent security feature.

According to a preferred embodiment, the security element is a security thread, i.e. the security element has the form of a thread or strip that is embedded at least partly into a document material, such as bank note paper, or can be disposed on the surface. The following examples will therefore be described with reference to this preferred form. However, it is likewise possible within the scope of the invention to give the security element any other desired outline form.

BRIEF DESCRIPTION OF THE DRAWINGS

In the following the invention will be described by way of example with reference to the accompanying figures. The proportions shown in the figures do not necessarily correspond to the relations existing in reality and serve primarily to improve clarity.

DETAILED DESCRIPTION OF THE INVENTION

FIGS. 1 to 6 each show the security element in a top view and, thereunder, schematically in a side view. The plan view shows the appearance of the security element the way it presents itself to the viewer in a top view with use of a white or light security element or in transmitted light with use of a transparent security element. The side view shows the particular layer structure of the security element. If it is a security thread, the width is usually in the range of 1 to 2 millimeters. All figures show only a short portion of the security thread, which is usually produced as an endless thread.

In the figures the same layer materials are consistently designated with uniform reference numbers.

Figure 1:
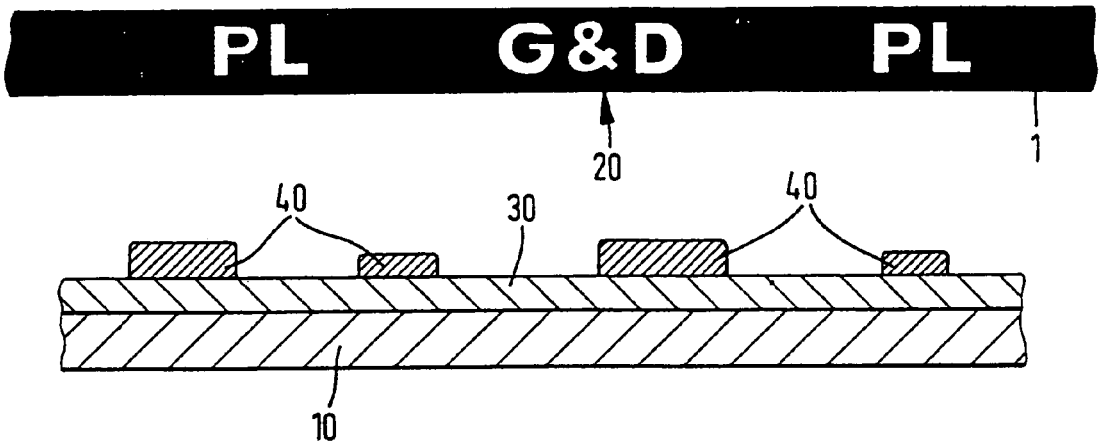
FIG. 1 shows a security element with a continuous electroconductive coating with a magnetic code printed thereover and an optical code in the electroconductive coating.

FIG. 1 shows continuously conductive, magnetically coded negative text element 1. That is, optical code 20 is formed by gaps forming characters in continuous, electroconductive coating 30 of security element 1. Security element 1 consists of transparent plastic 10 so that optical code 20 is visible in transmitted light if security element 1 is embedded for example in bank note paper or another security document.

Continuous coating 30 is printed with special magnetic code 40 that is not distinguishable in its optical appearance from coating 30 thereunder to the naked eye. Magnetic code 40 forms a bar code for example. In the simplest case the code can be a continuous coating, like continuous electroconductive coating 30 in the embodiment.

In this way the impartial viewer is not aware that the security element has not only optical codes 20 but also magnetic code 40. "Magnetic code" refers according to the present invention to any "magnetic coating" provided due to its special magnetic material properties for testing the authenticity of the security element by said magnetic properties. Such coatings may also be for example coatings of a material that is identifiable by magnetoresistors and thus reliably distinguishable from other materials of the security element.

The security element according to FIG. 1 has altogether three security features, namely optical code 20, magnetic code 40 and continuous electroconductivity 30. It is thus "triple coded." The inventive purpose is also attained, however, if coating 30 does not have any special physical properties and is for example a neutral printing ink. The most essential condition to be met by coating 30 is that it is optically indistinguishable from the material of magnetic ink 40.

Figure 2:
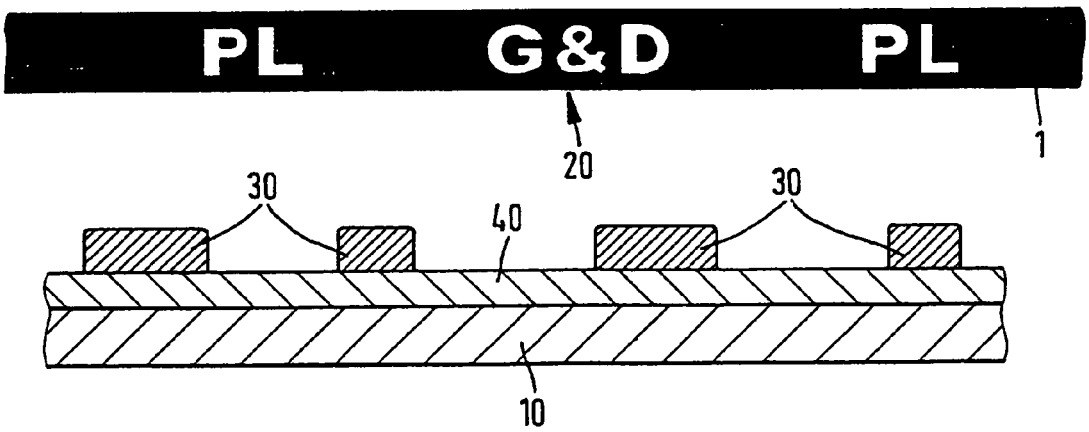
FIG. 2 shows a security element with a magnetic coating with a conductivity code printed thereover and an optical code in the conductivity code and the magnetic coating.

FIG. 2 shows similar security element 1 to FIG. 1 having a transparent plastic as carrier material 10 but being coated continuously with magnetic ink 40 which is coated with a special code of electroconductive ink 30. Instead of a special magnetic code this security element thus has special conductivity code 30, and instead of continuous electroconductivity this security element is continuously magnetic. In contrast to the security element shown in FIG. 1, optical code 20 is present not only in continuous magnetic coating 40 of security element 1 but also in areas of electroconductive coating 30. Since optical code 20 is negative writing, both magnetic layer 40 and electroconductive layer 30 have accordingly formed gaps in the areas of optical code 20. Continuous magnetic coating 40 could be replaced by a neutral printing ink in this embodiment, too, but this would reduce the number of security features of the security element from three to two.

Due to the elevated security and the special deception of the viewer and potential forger, the preferred embodiments of the invention provide three security features, an optical, a magnetic and an electroconductive security feature, said security features being produced using coating materials that are optically indistinguishable and applied to security element 1 in the form of printing inks by a suitable method, preferably printing technology. The printing technologies are for example screen printing, gravure, offset and flexography, whereby screen printing and gravure are preferred. The security features can of course also be applied by any other suitable method, such as spraying or vapor deposition technologies. If vapor deposition technologies are used, vacuum coating methods are preferred.

Figure 3:
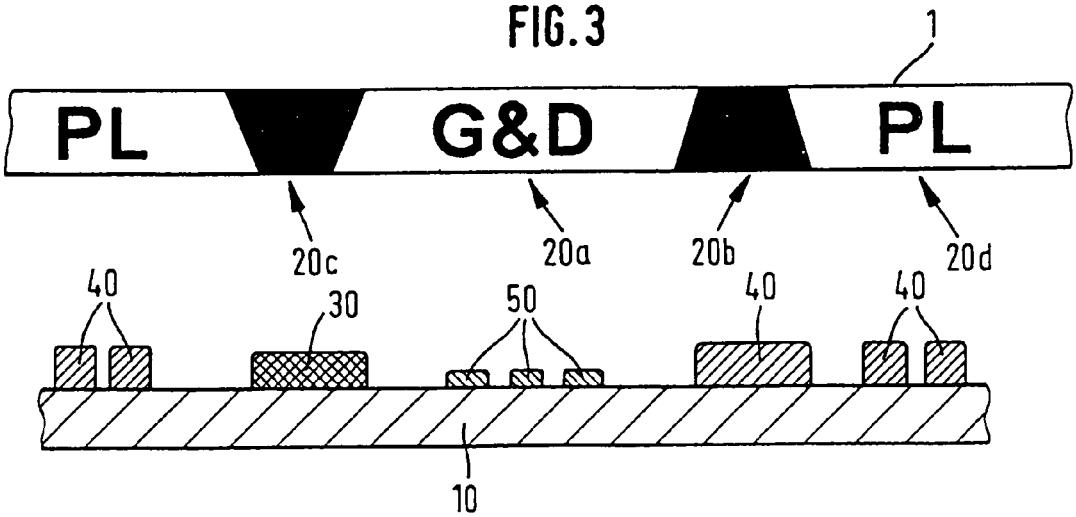
FIG. 3 shows a security element with spaced apart magnetic code, conductivity code and optical code.

FIG. 3 shows a further embodiment of inventive security element 1. In this case, optical code 20 consists of characters 20*a* and 20*d* and trapezoidal bars 20*b*, 20*c*. Individual components 20*a* to 20*d* of optical code 20 are each formed of a certain coating material on security element 1. Component 20*a* "G&D" is formed by coating 50 of neutral material without any special physical properties. Component 20*b* of the optical code and component 20*d* "PL" are formed by magnetic coating 40. Component 20*c* of the optical code is in turn formed by electroconductive coating 30. Character components 20*a* and 20*d* thus have different physical properties from each other, and trapezoidal bars 20*b*, 20*c* also have different physical properties from each other but different ones from character components 20*a*, 20*d*. The viewer at first suspects nothing of these different properties since the coating materials of optical code 20 are indistinguishable from each other to the naked eye. The coating is present on plastic carrier 10, as in FIG. 1.

Figure 4:
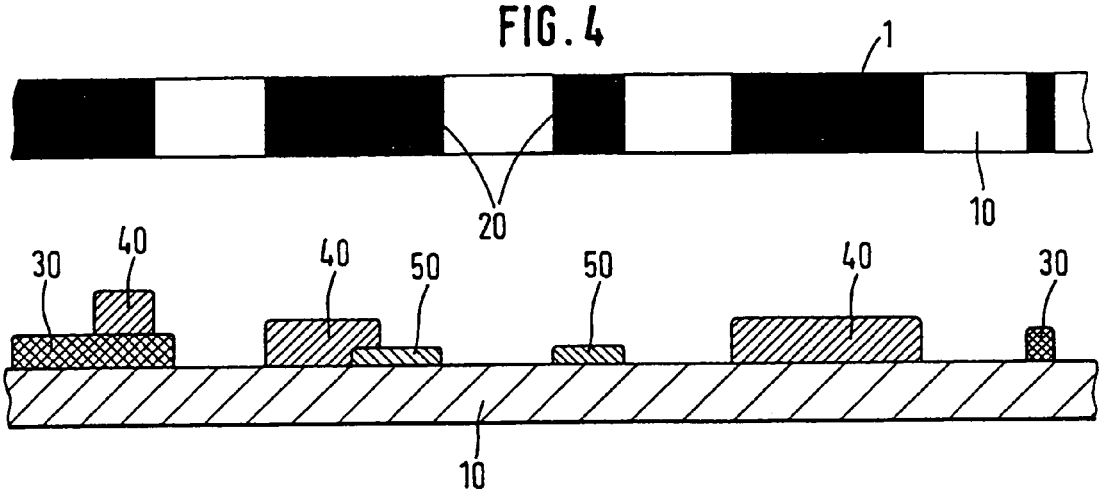
FIG. 4 shows a security element with a conductivity code partly superimposed by a magnetic code and forming an optical code therewith and with a third coating.

FIG. 4 shows inventive security element 1 whose optical code 20 is a bar code formed by uniformly spaced bars of different length. The viewer will at first think he is faced with a usual bar code. As can be seen by the side view of security element 1, however, the individual bars of bar code 20 are formed by different coating materials, namely by electroconductive coating portions 30, magnetic coating portions 40 and neutral coating portions 50 that are neither magnetic nor electroconductive. The element thus has conductivity code 30 due to electroconductive coating portions 30, magnetic code 40 due to magnetic coating portions 40, and optical code 20 due to the totality of electroconductive, magnetic and neutral coating portions 30, 40, 50.

Coating portions 50 thus serve to complete optical code 20 and it would be sufficient, deviating from the view according to FIG. 4, if coating portions 50 were only adjacent to magnetic and/or electroconductive portions 40, 30. However, this presupposes very high production precision to avoid gaps between the individual coating portions. It is therefore preferred due to the simpler producibility in particular by printing technology to dispose the coating portions so that adjacent coating portions overlap. Production tolerances are uncritical in this case. The coating is present on plastic carrier 10, as in FIG. 1.

Figure 5:
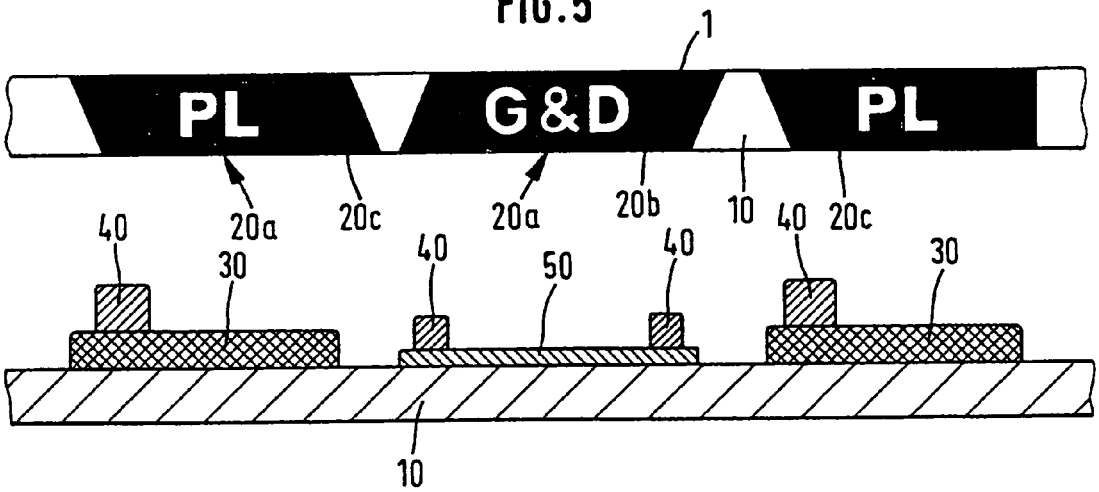
FIG. 5 shows a security element with a magnetic code superimposed on an optical code of electroconductive and neutral coating portions.

FIG. 5 shows a further embodiment of inventive security element 1 wherein optical code 20 again comprises characters 20*a* and bars 20*b*, 20*c*. Bars 20*c* with the negative writing "PL" consist of electroconductive coating 30, and bar 20*b* with the negative writing "G&D" consists of neutral, opaque printing ink 50. Electroconductive coating 30 thus forms a conductivity code that is not recognizable to the viewer in its special code form, since the viewer will assume that neutral coating area 50 is also part of the code. Additionally, the security element has a third code, namely magnetic code 40 formed by printing magnetic ink 40 on bars 20*a*, 20*b* in certain portions. The partial areas of magnetic code 40 are located outside negative writing 20*a* so that magnetic code 40 can be produced as a classic bar code by printing technology in very simple fashion. The coating is present on plastic carrier 10, as in FIG. 1.

Figure 6:
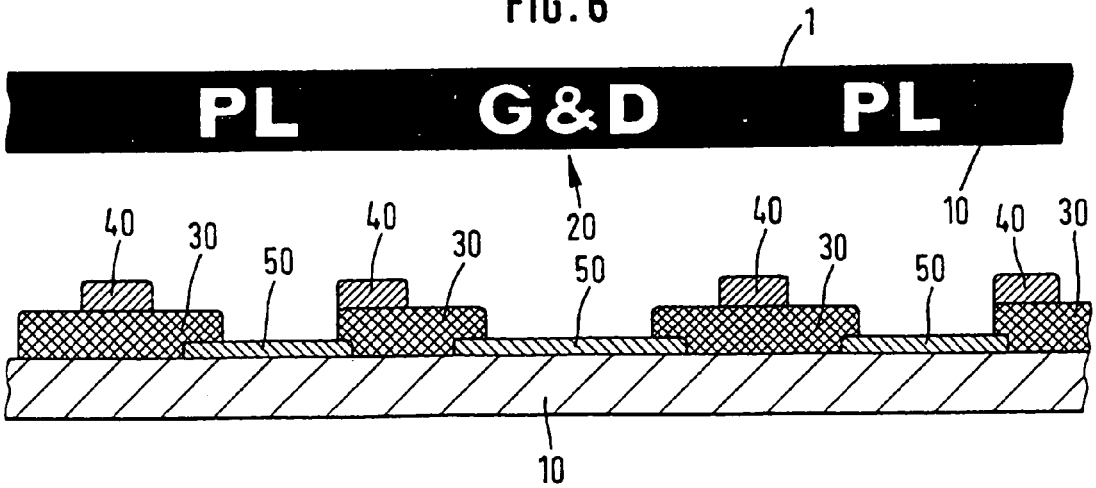
FIG. 6 shows a continuously coated security element with a conductivity code, thereover a magnetic code and a neutral coating between the two codes, and an optical code in the form of negative writing in the continuous coating.

FIG. 6 in turn shows inventive security element 1 that confronts the viewer as a continuously coated security element with negative writing 20. The security element has conductivity code 30 and magnetic code 40 different therefrom, said codes being formed by corresponding coatings 30, 40. Areas of the security element not covered by coating areas 30, 40 were previously printed with neutral, opaque ink 50. However, the coating order is irrelevant for the purposes of the invention, since in any case the resulting security element 1 appears to be printed completely opaque and has the same appearance from both sides even in the case of a transparent element. The coating is present on plastic carrier 10, as in FIG. 1.

In the case of a transparent security element, the coatings can also be present on different sides of carrier material 10.

Areas 40 forming the magnetic code on the security element can be divided into subclasses that differ in their magnetic remanence and/or coercive field strength. These different classes of magnetic areas can be distinguished from each other in identification machines by their different magnetic properties. The different magnetic and machine detectable properties of the subclasses can be adjusted by means of different magnetic materials or by means of a material varying in quantity and/or pigment distribution. Pigment distribution refers for example to the pigment size or the packing of the pigments (density).

The magnetic materials can be both hard- and soft-magnetic materials and mixtures thereof.

Magnetic inks that can be used are hard-magnetic pigments incorporated in binder, for example Fe3O4, and soft-magnetic powder inks, for example of Fe or NiFe.

Electroconductive areas 30 are produced just like magnetic areas 40 e.g. by means of printing inks by printing technology. This has the advantage that the optical appearance of the electroconductive ink can be readily adapted to the optical appearance of the magnetic ink. In addition it is possible without effort to provide gaps or special contours in the electroconductive coating for forming the optical code without any need for an elaborate demetalizing process for example. For printing the conductive areas it is possible to use for example inks like Electrodag from Acheson Industries or carbon black incorporated in binder, e.g. Printex XE2B from Degussa-Hüls AG.

The invention claimed is:

1. A security element comprising a carrier material equipped with a first coating of magnetic material forming a first code and a second coating of electroconductive material forming a second code and having in addition a third, optically readable code formed at least in certain areas by a third coating of nonmagnetic, nonelectroconductive material and covering at least partial areas of the security element not covered by a least one of the first coating or the second coating, said three coatings not being distinguishable from each other with the naked eye, wherein the optically readable code and at least one of the first and second coating are perceptible with the naked eye.

2. A security element according to claim 1, wherein the carrier material comprises transparent plastic.

3. A security element according to claim 1, wherein the security element is in the form of a thread or strip.

4. A security element according to claim 1, wherein the nonmagnetic, nonelectroconductive coating partly or completely overlaps the coating of the first code or the coating of the second code.

5. A security element according to claim 1, wherein the nonmagnetic, nonelectroconductive coating adjoins at least one of the coating of the first code or the coating of the second code.

6. A security element according to claim 1, wherein the three coatings do not overlap.

7. A security element according to claim 1, wherein each longitudinal portion of the security element is provided with at least one of said three coatings.

8. A security element according to claim 1, wherein the optically readable code comprises negative or positive writing.

9. A security element according to claim 8, wherein the negative or positive writing is present only in areas of the security element that are not covered either by the first, magnetic coating or by the second, electroconductive coating.

10. A security element according to claim 1, wherein at least one of the three coatings is present on both sides of the security element.

11. A security element according to claim 1, wherein the coating of the first code comprises magnetic materials that differ in at least one of their magnetic remanence or coercive field strength.

12. A security element according to claim 1, wherein the security element has a thermochromic security feature.

13. A security element according to claim 1, wherein the security element has a luminescent security feature.

14. A security element according to claim 1, wherein the materials of said three coatings are printing inks.

15. A security element according to claim 14, wherein the printing inks are opaque.

16. A security element according to claim 14, wherein the electroconductive material comprises carbon black incorporated in binder.

17. A security element according to claim 14, wherein the magnetic material comprises magnetic pigments incorporated in binder.

18. A security element according to claim 14, wherein the magnetic material comprises a soft-magnetic powder ink.

19. A security document comprising at least one security element according to claim 1.

20. A bank note comprising at least one security element according to claim 1.

21. A method for producing a security element according to claim 1, wherein said coatings are applied to, the security element.

22. A method according to claim 21, wherein the coatings are printed on by screen printing.

23. A method according to claim 21, wherein the coatings are applied by printing.

* * * * *